United States Patent [19]

Kanbara et al.

[11] 4,311,761

[45] Jan. 19, 1982

[54] FILAMENT FOR WIG

[75] Inventors: Youichi Kanbara, Kakogawa; Shunichiro Kurioka, Kobe, both of Japan

[73] Assignee: Kanegafuchi Kagaku Kogyo Kabushiki Kaisha, Osaka, Japan

[21] Appl. No.: 184,019

[22] Filed: Sep. 4, 1980

[51] Int. Cl.[3] ..... D02G 3/00

[52] U.S. Cl. ..... 428/397; 132/53; 132/56; 57/253

[58] Field of Search ..... 428/397; 132/53, 56; 57/253

[56] References Cited

U.S. PATENT DOCUMENTS

| | | | |
|---|---|---|---|
| 2,637,893 | 5/1953 | Shaw | 428/397 |
| 3,121,040 | 2/1964 | Shaw et al. | 428/397 |
| 3,194,002 | 7/1965 | Raynolds et al. | 428/397 |
| 3,508,390 | 4/1970 | Bagnall et al. | 428/397 |

*Primary Examiner*—J. Travis Brown

*Attorney, Agent, or Firm*—Moonray Kojima

[57] ABSTRACT

A synthetic fiber filament usable for the manufacture of wigs, comprising, in cross section, a center portion, and connected thereto and extending outwardly therefrom three substantially rectangular portions. The novel structure provides unexpectedly good and durable tight curls and bulkness.

6 Claims, 3 Drawing Figures

FILAMENT FOR WIG

BACKGROUND OF THE INVENTION

This invention relates to synthetic fiber filaments used, for example, as artificial hair in wigs, and more particularly to the structure of such filament.

In the prior art, many different structures have been used for synthetic fiber filaments used to construct wigs. For example, previously employed were such cross sectional shapes as circular, horseshoe, dogbone, ribbon, quatrefoil, starlike and the like. The types of cross sectional shapes selected were for their physical characteristics and the properties imparted to the wigs, such as sense of touch, appearance, luster and beauty function of the wig. Wig styles may be classified roughly as short, medium and long. It is known that the functions or properties of a wig which are desired can be obtained by, for example, varying the type of synthetic fiber used, and by also varying their cross sectional shape.

In some wigs, it is also desired to have tight curls and bulkness. Prior to the invention, none of the known fiber structures were able to provide these desired results consistent with easy manufacturing of the fiber filament.

SUMMARY OF THE INVENTION

Accordingly, an object of the invention is to overcome the above and other deficiencies and disadvantages of the prior art.

Another object is to provide a synthetic fiber filament which is usable in wigs and which has a unique and novel structure that provides in the wig, tightness and durability of curls and bulkness.

The foregoing and other objects and advantages of the invention are attained in the invention, which comprises a synthetic fiber filament having a unique and novel structure. The filament comprises, in cross section, a center portion through the center of which runs an axis of the filament, and connected thereto or as an integral part thereof and extending outwardly therefrom, three substantially rectangular portions. The rectangular portions have a lateral dimension and a transverse dimension, and a preferred ratio of the lateral dimension to the transverse dimension is between 1 to 3. The cross sectional area of the center portion is preferably $\sqrt{3}/12$ to 1.5 times the total cross sectional areas of the three rectangular portions. The angle defined by center lines of two adjacent rectangular portions and extending from the axis, is preferably between 90° to 150°, and more preferably 100° to 140°. Advantageously, it was discovered that the inventive filament structure produced good tight and durable curls and bulkness, together with easy production of such filaments.

A feature of the invention is the filament structure wherein three cross sectional rectangular portions are connected to or as an integral part of and extending from a center portion.

Another feature is the ratio of the length dimension of the rectangular portion to the transverse dimension being preferably between 1 and 3.

A further feature is the cross sectional area of the center portion being $\sqrt{3}/12$ to 1.5 times the total cross sectional areas of the three rectangular portions.

Another feature is the angle between the center lines of two adjacent rectangular portions extending from the axis of the center portion being preferably 90° to 150°, and more preferably between 100° to 140°.

A further feature is that the filament is made of a synthetic fiber selected from the group consisting of vinyl chlorides, arylates and mixtures thereof.

DETAILED DESCRIPTION OF THE PREFERRED EMBODIMENTS

Figure 1:
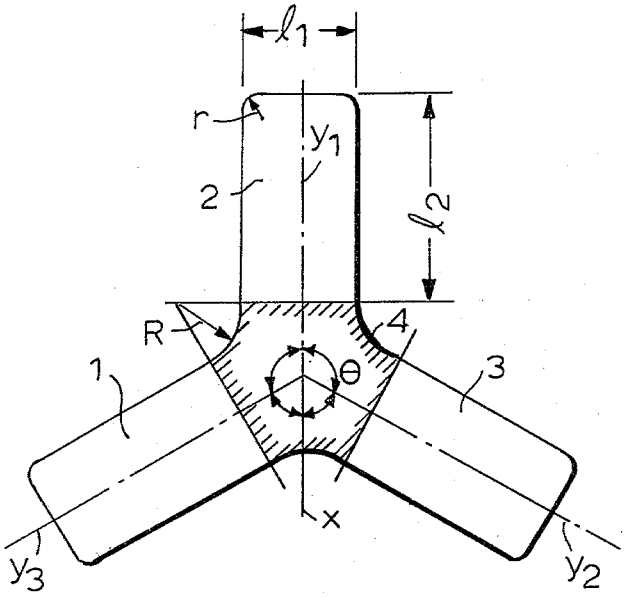
FIG. 1 depicts, in cross section, an illustrative embodiment of the invention.

Turning now to the drawing, In FIG. 1, there is depicted in cross section, a synthetic fiber filament, which is usable, for example, in the production of wigs. The structure comprises, in cross section, three rectangular portions 1,2,3, connected to or as an integral part of the center portion, and extending outwardly from a center portion 4 which is defined within the area shown by the partial cross hatchings. The rectangular portions 1,2,3 have a lateral dimension $l_2$ and a transverse dimension $l_1$. It is preferable that the ratio of the lateral dimension $l_2$ to the transverse dimension $l_1$ be within the range of 1 to 3. It has been discovered that the nobility is not sufficient when the ratio is less than 1. Moreover, when the ratio is larger than 3, the curl imparted to the filament will not be sufficiently tight and durable.

The ratio of the cross sectional area of the center portion 4 is preferably between $\sqrt{3}/12$ to 1.5 times the total areas of the three rectangular portions 1,2,3. Filaments having such range of ratios have been discovered to have great bending rigidity against their own weight and against external forces, and their deformation can easily recover. Consequently, curls formed of the inventive filament are tightly maintained and remarkably excellent in bulkness. The property of bulkness is due to the projecting rectangular portions and may be lowered when the surface area of the center portion 4 vis-a-vis the total area of the three rectangular portions is toward the upper limit of the stated ratio. The lower limit of the ratio is the theoretical minimum value.

The radius of curvature "R" of the center portion 4 between the rectangular portions 1,2,3 may be suitable within the range of from a smooth curve to a straight line. The radius of curvature "r" formed at the ends of the rectangular portions 1,2,3, is preferably between 0 and $l_1/2$. However, it has been found that both radius of curvatures "R" and "r" do not appear to greatly influence the characteristics of the filament being sought in the invention. Thus, such radius of curvature can be adjusted as desired.

The angle $\theta$ formed, for example, by the center lines "$y_1$" and "$y_2$" of two adjacent rectangular portions 2 and 3, extending from the axis "x" of the center portion, is preferably between 90° to 150°, and more preferably between 100° to 140°. These angles provide optimal bulkness and ratios of cross sectional areas consistent with the overall shape of the structure.

Figure 2A:
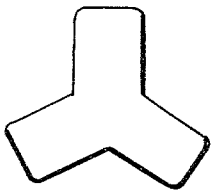
FIGS. 2*a*, 2*b* and 2*c* depict, in cross section, other embodiments of the invention, wherein the center portion and the three rectangular portions are varied in dimensions.
Figure 2B:
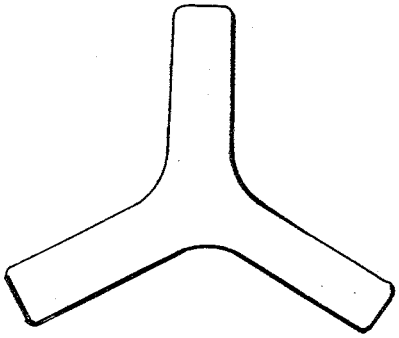
Figure 2C:
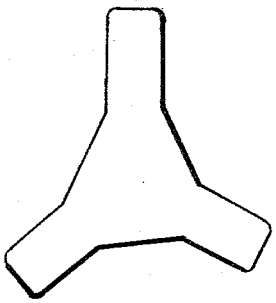

FIGS. 2*a* and 2*b* and 2*c* show examples of cross sectional shapes of the invention. FIG. 2*a* depicts an embodiment wherein the ratio of lateral dimension $l_2$ to transverse dimension $l_1$ is nearly 1. FIG. 2*b* shows an embodiment wherein the ratio is nearly 3. FIG. 2*c* shows an embodiment wherein the cross sectional area of the center portion 4 defined by the partial cross hatchings in FIG. 1, is nearly the same as the total cross sectional areas of the three rectangular portions 1,2,3.

Figure 3A:
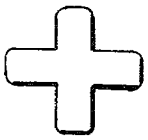
FIGS. 3*a* and 3*b* depict, in cross section, as comparisons four and five rectangular portions.
Figure 3B:
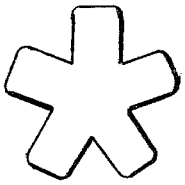

FIGS. 3*a* and 3*b* show examples of cross sectional shapes of filament having more than three rectangular portions, namely, in FIG. 3*a* there is depicted four rectangular portions and in FIG. 3*b* there is depicted five rectangular portions. In FIG. 3*a*, the rectangular portions are comparatively small vis-a-vis the center portion area. Hence, the desired bulkness is not obtained. In FIG. 3*b*, the rectangular portions are still smaller and bulkness is remarkably decreased. The inventive three rectangular portions provide optimal bulkness. Having only two rectangular portions provides insufficient tightness and durability of curls, and also insufficient bulkness is attained.

The present inventive filament, preferably has a diameter of between 20 to 50 denier. (The diameter measurement is made by considering the external end surfaces of the rectangular portions to form the fiber surfaces with the axis of the center portion being the axis of the filament.) The filament can be made of synthetic fibers, such as for example, vinyl chlorides and/or acrylates, which are generally used materials for wig fibers. They can be spun easily by means of an irregular cross sectional spinneret having figures similar to those of the filament. Any known process can be used, such as wet spinning, dry spinning and melt spinning.

As described the inventive synthetic fiber filament provides a practical and valuable fiber for use as a synthetic hair material for wigs. Advantageously, the inventive filament structure enables imparting of styles such as short curl, medium combination to wigs and freedom characterized by tight curls.

The foregoing description is illustrative of the principles of the invention. Numerous modifications and extensions thereof would be apparent to the worker skilled in the art. All such modifications and extension are to be considered to be within the spirit and scope of the invention.

What is claimed is:

1. Artificial human hair particularly adapted for use in wigs and made of a filament for use in a wig, comprising in cross section, a center portion and three substantially rectangular portions extending outwardly from said center portion, said rectangular portions having a lateral dimension and a transverse dimension and a center line, said center portion having at substantially its center an axis extending the length of said filament with said center lines of said rectangular portions extending outwardly to form an angle between two adjacent ones of said rectangular portions, wherein the ration of said lateral dimension to said transverse dimension is between 1 to 3, wherein the cross sectional area of said center portion is from $\sqrt{3}/12$ to 1.5 times the total cross sectional areas of said three rectangular portions, and wherein said artificial human hair has the properties of maintenance of tight curls and bulkiness.

2. The artificial human hair of claim 1, wherein said angle is between 90° to 150°.

3. The artificial human hair of claim 2, wherein said angle is between 100° to 140°.

4. The artificial human hair of claim 1, wherein said filament is made of a synthetic fiber selected from the group consisting of vinyl chlorides, acrylates, and mixtures thereof.

5. The artificial human hair of claim 1, wherein said center portion and said three rectangular portions are integrally of the same material.

6. The artificial human hair of claim 1, wherein said three rectangular portions are connected to said center portion.

* * * * *